United States Patent [19]

Marshall et al.

[11] Patent Number: 5,011,616

[45] Date of Patent: Apr. 30, 1991

[54] FINISH COMPOSITION FOR FINE DENIER POLYAMIDE YARN

[75] Inventors: Robert M. Marshall, Chesterfield, Va.; James C. Raybon, Jr., Columbia; Robert W. Medeiros, Irmo, both of S.C.

[73] Assignee: Allied-Signal Inc., Morris Township, Morris County, N.J.

[21] Appl. No.: 484,132

[22] Filed: Feb. 23, 1990

[51] Int. Cl.[5] ..... D06M 13/17; D06M 13/224; D06M 13/256; D06M 15/53

[52] U.S. Cl. ..... 252/8.7; 252/8.6; 252/8.9; 8/115.6; 66/125 A

[58] Field of Search ..... 252/8.6, 8.7, 8.8, 8.9; 8/115.6

[56] References Cited

U.S. PATENT DOCUMENTS

| | | | |
|---|---|---|---|
| 3,428,560 | 2/1969 | Olsen | 252/8.9 |
| 3,575,856 | 4/1971 | Anton | 252/8.9 |
| 3,649,535 | 3/1972 | Clark et al. | 252/8.75 |
| 3,781,202 | 12/1973 | Marshall et al. | 252/8.9 |
| 4,066,558 | 1/1978 | Shay et al. | 252/8.9 |
| 4,105,569 | 8/1978 | Crossfield | 252/8.6 |
| 4,126,564 | 11/1978 | Marshall et al. | 252/8.9 |
| 4,192,754 | 3/1980 | Marshall et al. | 252/8.8 |
| 4,193,880 | 3/1980 | Marshall | 252/8.6 |
| 4,242,095 | 12/1980 | Carver | 252/8.9 |
| 4,283,292 | 8/1981 | Marshall et al. | 252/8.6 |
| 4,624,793 | 11/1986 | Phifer et al. | 8/115.6 |
| 4,816,336 | 3/1989 | Allou, Jr. et al. | 252/8.9 |

OTHER PUBLICATIONS

Update on fiber finishers: What's happening now? Why? by Harry R. Billica, Fiber Producer, Apr. 1984.

Fiber finishes formulation and evaluation by Harry R. Billica, Fiber Producer, Jun. 1984.

*Primary Examiner*—Prince E. Willis

*Assistant Examiner*—J. Darland

[57] ABSTRACT

Enhanced knitting performance for fine denier polyamide apparel yarn is obtaining by applying to the yarn a finish composition comprising (a) an ester selected from the group consisting of n-butyl stearate, iso-butyl stearate and combinations thereof, said ester being present in an effective amount to provide enhanced knitting performance for said yarn;

(b) a polyethylene glycol ester;

(c) a polyethylene glycol ether;

(d) a polyethylene glycol glyceride;

(e) an alkyl phosphate; and (f) a sulfonated ester.

16 Claims, No Drawings

FINISH COMPOSITION FOR FINE DENIER POLYAMIDE YARN

BACKGROUND OF THE INVENTION

Field of the Invention

The present invention relates to a finish composition for fine denier apparel fiber which provides significantly improved knitting performance, production performance and fabric quality.

Fine denier polyamide yarns of 12 to 100 denier, more often 15 to 70 denier are provided for apparel applications including hosiery and ladies lingerie. Such fabrics are produced by knitting operations. The fine denier of the yarn causes difficulty in the knitting operation with defects in the knitted fabric that can result from failure of the fine denier yarn filaments during the knitting process.

As many as 10,000 parallel ends of fine denier polyamide fiber are simultaneously knitted on a flat tricot knitting machine to form the fabric. A measure of knitting performance is determined by the racks per defect where a rack is a 60 inch length of fabric with 480 courses of knitting per rack.

It is desired to provide enhanced knitting performance for fine denier polyamide yarn.

SUMMARY OF THE INVENTION

Enhanced knitting performance for fine denier polyamide apparel yarn is obtaining by applying to the yarn a finish composition comprising (a) an ester selected from the group consisting of n-butyl stearate, iso-butyl stearate and combinations thereof, said ester being present in an effective amount to provide enhanced knitting performance for said yarn;

(b) a polyethylene glycol ester;

(c) a polyethylene glycol ether;

(d) a polyethylene glycol glyceride;

(e) an alkyl phosphate; and (f) a sulfonated ester.

DESCRIPTION OF THE PREFERRED EMBODIMENT

A finish composition comprising a blend of esters, nonionic cohesive aids, and phosphate ester when applied to fine denier polyamide apparel yarn has been found to significantly improve production performance, knitting performance and fabric quality.

For purposes of the invention, fine denier polyamide apparel yarn is contemplated to include 12 to 100 denier yarn, preferably 15 to 70 denier yarn.

The finish composition of the present invention can be incorporated into an aqueous emulsion and applied to the yarn during spinning as a spin finish in ways known to those skilled in the art. For an aqueous emulsion, the finish oil is combined with sufficient water to result in 2 to 30 weight percent oil in the emulsion, a preferred range being 10 to 24 weight percent. Alternatively, the finish may be applied as an oil overfinish to the drawn yarn.

The finish composition comprises (a) an ester selected from the group consisting of n-butyl stearate, iso-butyl stearate and combinations thereof, said ester being present in an effective amount to provide enhanced knitting performance for said yarn;

(b) a polyethylene glycol ester;

(c) a polyethylene glycol ether;

(d) a polyethylene glycol glyceride;

(e) an alkyl phosphate; and (f) a sulfonated ester.

The finish composition preferably comprises 25 to 65 weight percent (a), 2 to 20 weight percent (b), 4 to 16 weight percent (c), 5 to 25 weight percent (d), 0.2 to 2 weight percent (e), and 0.1 to 4 weight percent (f), weight percent being based on the oil portion of the composition. More preferably, the finish composition comprises 25 to 65 weight percent (a), 5 to 12 weight percent (b), 8 to 12 weight percent (c), 10 to 20 weight percent (d), 0.5 to 1.5 weight percent (e), and 0.5 and 2 weight percent (f).

While the ester component (a) may be selected from the group given above, it is preferred that a combination, or blend of n-butyl stearate and iso-butyl stearate be selected.

The following examples disclose a particularly preferred embodiment.

EXAMPLE 1

The following finish composition was prepared

| Component | Weight Percent |
|---|---|
| (a) n-butyl stearate | 30 |
| iso-butyl stearate | 35 |
| (b) [1]polyoxyethylene (9) pelargonate | 8 |
| (c) [2]polyoxyethylene (3) cetyl-stearyl ether | 10 |
| (d) [3]polyoxyethylene (25) castor oil | 15 |
| (e) [4]tridecyl phosphate | 1.0 |
| (f) [5]sodium dinonyl sulfosuccinate | 1.0 |
| | 100.0 |

Footnotes:

[1]9 moles of ethylene oxide on pelagonic ($C_9$) fatty acid range of EO 4–16, preferred 7–12; fatty acid range from $C_6$–$C_{18}$, preferred $C_8$–$C_{12}$ or blends.

[2]3 moles of EO on $C_{16}$–$C_{18}$ fatty alcohol range EO 1–10, preferred 2–6; alcohol range $C_8$–$C_{36}$, preferred $C_{12}$–$C_{22}$.

[3]25 moles of EO on castor oil range of EO 10–40, preferred 16–30.

[4]Tridecyl (13 carbon) alcohol phosphated free acid (not neutralized); range of alcohol $C_6$–$C_{18}$, preferred $C_8$–$C_{16}$ can neutralize with sodium, potassium, lithium, or amines, preferred not neutralized.

[5]Dinonyl (9 carbon) ester of succinic acid; sulfonated and neutralized with sodium, potassium, or lithium; range of alcohol $C_6$–$C_{13}$, preferred $C_8$–$C_{12}$.

EXAMPLE 2

The finish of example 1 was applied from a 12% oil-in-water emulsion to 20 denier tricot direct draw entangled yarn at 1.2 weight percent oil on yarn. For a control finish, a commercially available heat stable finish (Goulston NF-722) was utilized.

| | Yarn Production Performance |
|---|---|
| | % spinning completes |
| Invention | 95 |
| Control | 90 |

Spinning completes are defined as the number of full doffs completed during spinning, expressed here as a percentage and showing improved yarn production for the invention over the control.

The yarn of the invention and the control yarn was knitted on a Karl Mayer model K4 knitting machine with the following results:

| | Yarn Product Performance | | |
|---|---|---|---|
| | [6]Yarn-to-Metal friction | [7]Knitting Performance racks/defect | [8]dye rate |
| Invention | 15 grams | 4522 | 6.5 |
| Control | 27 grams | 686 | 3 |

Footnotes:
[6]reported in grams of force required to draw yarn over a ¼ inch polish chrome plated stainless pin RMS 2-3 at 200 ft/min, 360° contact.
[7]Knitting performance - flat tricot rack is equal to 60 inches of fabric with 480 courses per rack, consists of 10,000 parallel ends.
[8]Relative speed at which dye is exhausted from solution onto the fabric. Higher rate indicates less interference of finish with dyeing. High dye rate is desirable in continuous dyeing systems.

EXAMPLE 3

Additional knitting trails were held at two mill locations for the spin finish of example 1, using the NF-722 control finish as a control. The data shown is for a 20 denier/12 filament pentalobal yarn product which is a very fine denier and very difficult to knit. At both locations Mayer HKS2 compound needle knitting equipment was used. Knitting speed at each location was a constant speed in the range of 1200 to 1800 courses per minute. Knitting performance is measured in racks/-defect (R/D).

| | Location 1 | Location 2 |
|---|---|---|
| Invention | 2000-3000 R/D | 3000-4000 R/D |
| Control | 700-1000 R/D | 1600-1800 R/D |

Substantial improvement in knitting performance is provided by the finish composition of the invention.

What is claimed:

1. A finish composition for fine denier apparel polyamide yarn comprising an oil portion comprising (a) 25 to 65 weight percent of an ester selected from the group consisting of n-butyl stearate, iso-butyl stearate, and combinations thereof, said ester being present in an effective amount to provide enhanced knitting performance of said yarn;

(b) 2 to 20 weight percent polyoxyethylene (9) perlargonate;

(c) 4 to 16 weight percent polyoxyethylene (3) cetylstearyl ether;

(d) 5 to 25 weight percent polyoxyethylene (25) castor oil;

(e) 0.2 to 2 weight percent tridecyl phosphate;

(f) 0.1 to 4 weight percent sodium dinonyl sulfosuccinate.

2. The finish composition of claim 2 additionally comprising 2 to 30 weight percent of said oil portion in an aqueous emulsion.

3. The finish composition of claim 2 wherein (a) is a combination of 25 to 35 weight percent n-butyl stearate and 30 to 40 weight percent iso-butyl stearate.

4. The finish composition of claim 3 comprising 10 to 24 weight percent of said oil portion in an aqueous emulsion and comprising 5 to 12 weight percent (b), 8 to 12 weight percent (c), 10 to 20 weight percent (d), 0.5 to 1.5 weight percent (e), and 0.5 to 2 weight percent (f).

5. The finish composition of claim 1 wherein (a) is a combination of 25 to 35 weight percent n-butyl stearate and 30 to 40 weight percent iso-butyl stearate.

6. Polyamide apparel yarn of 12 to 100 denier having deposited thereon the composition of claim 1 in an amount sufficient to provide enhanced knitting performance.

7. The yarn of claim 6 of 15 to 70 denier.

8. Polyamide apparel yarn of 12 to 100 denier having deposited thereon the composition of claim 7 in an amount to provide enhanced knitting performance.

9. The yarn of claim 8 of 15 to 70 denier.

10. Polyamide apparel yarn of 15 to 70 denier having deposited thereon the composition of claim 3 in an amount sufficient to provide enhanced knitting performance.

11. Polyamide apparel yarn of 15 to 70 denier having deposited thereon the composition of claim 4 in an amount sufficient to provide enhanced knitting performance.

12. A method of knitting fine denier polyamide yarn comprising applying to said yarn the finish composition of claim 1 in an amount sufficient to provide enhanced knitting performance.

13. A method of knitting fine denier polyamide yarn comprising applying to said yarn the finish composition of claim 3 in an amount sufficient to provide enhanced knitting performance.

14. A method of knitting fine denier polyamide yarn comprising applying to said yarn the finish composition of claim 7 in an amount sufficient to provide enhanced knitting performance.

15. A method of knitting fine denier polyamide yarn comprising applying to said yarn the finish composition of claim 3 in an amount sufficient to provide enhanced knitting performance.

16. A method of knitting fine denier polyamide yarn comprising applying to said yarn the finish composition of claim 4 in an amount sufficient to provide enhanced knitting performance.

* * * * *

UNITED STATES PATENT AND TRADEMARK OFFICE

CERTIFICATE OF CORRECTION

PATENT NO. : 5,011,616

DATED : April 30, 1991

INVENTOR(S) : Robert M. Marshall, James C. Raybon, Jr. and Robert W. Medeiros

It is certified that error appears in the above-identified patent and that said Letters Patent is hereby corrected as shown below:

Col. 4, line 1, "claim 2" should read --claim 1--

Signed and Sealed this

Eighth Day of September, 1992

*Attest:*

DOUGLAS B. COMER

*Attesting Officer*

*Acting Commissioner of Patents and Trademarks*